United States Patent [19]

Rose et al.

[11] Patent Number: 4,830,624

[45] Date of Patent: May 16, 1989

[54] TWIST-ON BATTERY CONNECTOR

[76] Inventors: Keith A. Rose, 219 Penick Ave.; Ramon J. Ascencio, 197 N. Sandusky St., both of Delaware, Ohio 43015

[21] Appl. No.: 154,974

[22] Filed: Feb. 9, 1988

[51] Int. Cl.[4] ..... H01R 4/24

[52] U.S. Cl. ..... 439/388

[58] Field of Search ..... 439/387, 388, 759, 760

[56] References Cited

U.S. PATENT DOCUMENTS

| | | | |
|---|---|---|---|
| 1,994,251 | 3/1935 | Mueller | 439/388 |
| 2,199,532 | 5/1940 | Weeks | 439/387 |
| 2,623,085 | 12/1952 | Gier, Jr. | 439/759 |
| 2,793,350 | 5/1957 | Anderson | 439/388 |
| 4,062,613 | 12/1977 | Tritenne | 439/388 |

FOREIGN PATENT DOCUMENTS

| | | | |
|---|---|---|---|
| 954974 | 1/1950 | France | 439/759 |

*Primary Examiner*—Joseph H. McGlynn
*Attorney, Agent, or Firm*—Mueller and Smith

[57] ABSTRACT

Disclosed is a battery connector for attaching an electrical cable to the terminal post of a battery. The connector has a hole penetrating therethrough which is adapted to fit around the terminal post. The interior surface of the hole bears a threading helix having a diameter less than that of the terminal post for screwing said connector onto said terminal post.

10 Claims, 2 Drawing Sheets

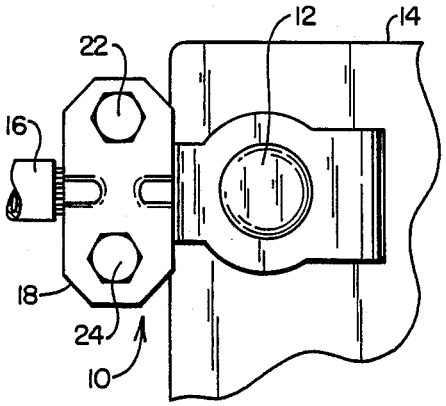
FIG. 1
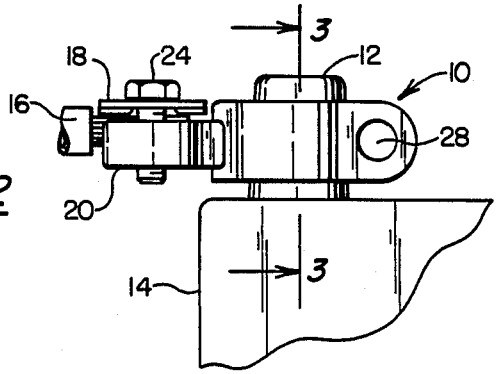
FIG. 2
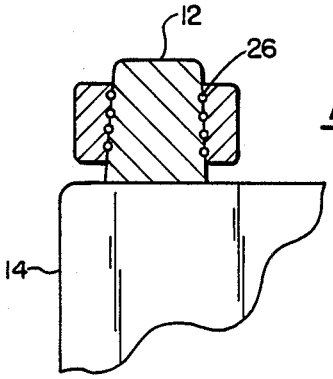
FIG. 3
FIG. 4
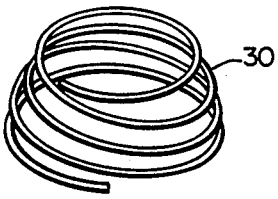
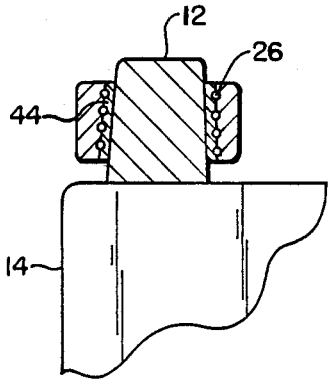
FIG. 9

TWIST-ON BATTERY CONNECTOR

BACKGROUND OF THE INVENTION

The present invention is directed to battery connectors for attaching electrical cable to battery terminal posts, e.g. car batteries, and more particularly to an easy-to-use, quick-connect, reusable battery connector.

Typical storage batteries utilize tapered lead rods for the terminals. This is especially true of automobile batteries. Heretofore, battery connectors were provided with similarly-tapered holes which fit over the terminals and which relied on large bolts to externally clamp the connector about the terminal. Despite conforming to the tapered terminal, effective contact between the terminal and the connector was not guaranteed due to manufacturing tolerances of both devices, surface irregularities, and like causes. Because the battery connectors also usually consist of soft lead, the external clamping bolts also tended to deform the connector at its clamping site in addition to clamping the matching tapered surfaces of the connector and battery terminal. These soft materials of construction also made it inadvisable to torque down the clamping bolt to fully seat the two surfaces since the extra force needed for such proper seating usually resulted in distorting the connector at its clamping site. While this could be done once, if the connector were removed from the battery terminal for reuse, the resulting distortion became a significant impediment to such reuse or further tightening of the connector.

Contact surfaces not fully seated are subject to oxidation resulting in surface corrosion which inhibits a good electrical connection. Additionally, vibration often contributes to a loosening of the connector or the lead connector may relieve itself of the stress imposed on it by the external clamping force, both actions resulting in incomplete seating or contact resulting in poor electrical conduction and/or further exposed surfaces for surface oxidation. Once the connector or terminal has oxidized, further tightening of the connector is of little value absent removal of the connector for removal of the surface oxidation from the connector and the battery terminal.

Finally, it will be realized that the soft materials of construction result in distortion of the battery terminal, thus making further tightening of an existing connector, or the installation of a new connector difficult. As a practical matter, once a battery connector has been removed from a battery, it typically cannot be reused, thus necessitating the purchase of a new connector.

BROAD STATEMENT OF THE INVENTION

The present invention is addressed to overcoming the problems associated with conventional battery connectors which attach an electrical cable to a terminal post of a battery. The connector of the present invention has a hole penetrating therethrough which is adapted to fit around the terminal post of the battery. The interior surface of the hole bears a threading electrically-conductive helix having a diameter less than that of the terminal post for screwing said connector onto said terminal post. Accordingly, the method for installation of the battery connector of the present invention comprises turning or screwing the battery connector to the terminal post of a battery. The threading helix of the battery connector acts as a die to thread the terminal post, resulting in excellent electrical contact being established as well as contributing to full seating of the connector to the terminal post.

Advantages of the present invention include a battery connector which is simple and convenient to utilize due to its quick-connect design. Another advantage is the ability to reuse the battery connector of the present invention multiple times. A further advantage is the ability to merely turn the battery connector further for re-tightening of the battery connector should it become lose, e.g. due to vibration. These and other advantages will be readily apparent based on the disclosure contained herein.

BRIEF DESCRIPTION OF THE DRAWINGS

FIG. 1 is a plan view of the top of the inventive battery connector affixed to a terminal post of a battery which is only partially shown;

FIG. 2 is a side elevational view of the battery connector depicted at FIG. 1;

FIG. 3 is a cross-sectional elevational view taken along line 3—3 of FIG. 2;

FIG. 4 depicts a spring connector which can be used in another embodiment of the battery connector of the present invention;

FIG. 9 is a cross-sectional elevational view like that in FIG. 3, but with a sheet of lead wrapped around the terminal post prior to the connector being screwed thereonto.

Figure 5:
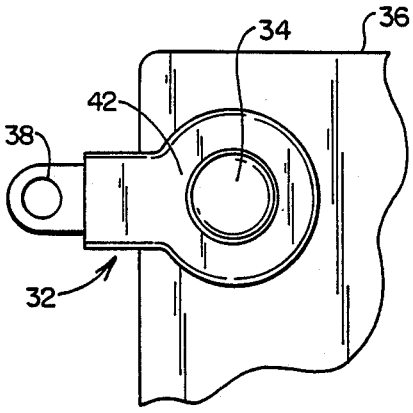
FIG. 5 is a plan view of the top of another embodiment of the inventive battery connector affixed to a terminal post of a battery only partially shown.
Figure 6:
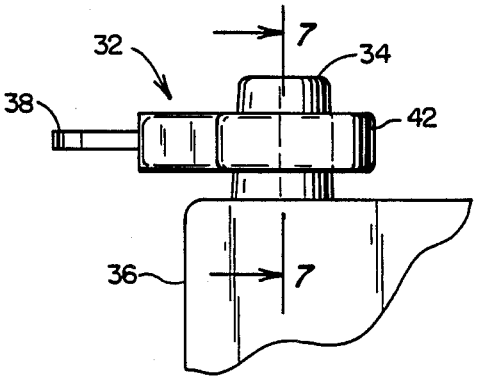
FIG. 6 is a side elevational view of the battery connector depicted at FIG. 5.

The drawings will be described in detail in connection with the following description of the invention.

DETAILED DESCRIPTION OF THE INVENTION

The inventive battery connector provides a quick and easy means of connecting a conducting cable to a tapered or non-tapered battery terminal post. Connection requires no tools though a screwdriver or other similar lever can be used to advantage if desired. The tapping or threading action of the connector does minimal damage to the battery terminal post and to the connector itself. Therefore, the connector is reusable throughout the life of the battery and can even be used throughout the life of several batteries. The connection between the inventive battery connector and the terminal post of the battery is so secure that the battery can be lifted and carried by the battery connectors, if desired.

Referring to FIG. 1, inventive battery connector 10 is seen affixed to battery terminal post 12 of storage battery 14 which may be an automobile battery. Battery connector 10 is affixed at its opposite end to electrical cable 16. It will be appreciated that the other battery post, though not depicted in the drawings, similarly is configured. Electrical cable 16 can be conventionally connected to battery connector 10 via upper pressure plate 18, lower plate 20, and bolts 22 and 24. It will be appreciated that a variety of conventional means can be used to connect electrical cable 16 to connector 10.

Referring additionally to FIGS. 2 and 3, it will be observed that battery connector 10 contains threading helix 26 which has threaded terminal 12 by its installation about terminal post 12. The conventional tapered configuration of terminal post 12 also can be seen from FIG. 3 as well as the conforming tapered configuration of the interior surface of the hole penetrating through battery connector 10. At the side opposite electrical cable 16, electrical battery connector 10 has transverse hole 28 penetrating therethrough. It will be appreciated that conventional electrical connectors can be split at this location with a bolt thrust through hole 28 for clamping conventional battery connectors onto battery terminal posts. The inventive connector, however, can utilize hole 28 for insertion of a screwdriver or similar lever which can aid in installing and removing battery connector 10 from terminal post 12, if necessary, desirable, or convenient.

Threading helix 26 preferably is molded into the interior surface of battery connector 10 and is under compression so that its spring-like configuration is tensioned against the interior surface of battery connector 10. Sufficient area of threading helix 26 is displaced inwardly from the interior surface of battery connector 10 so that upon twisting or screwing battery connector 10 onto terminal post 12, the helix acts as a threading die to thread the exterior side surface of terminal post 12. This threading action creates additional tensional force within threading helix 26 (which conveniently may be thought of as a helical spring, often tapered in configuration) which further contributes to a firm securement being established between connector 10 and post 12.

Since conventional terminal posts are made of lead, as are conventional battery connectors, it is preferred that threading helix 26 be made of an electrically conductive metal which is harder than lead, e.g. copper or the like. By use of copper, threading helix 26 is threaded into terminal post 12 resulting in an enhanced area of electrical conductance and mechanical strength established between threading helix 26 and terminal post 12. An additional unique advantage is gained by this construction. As the helix acts as a die to thread post 12, the softer lead of the terminal in the threads is displaced. This displaced metal has no place to go except to flow into the area between each vertically adjacent loop of helix 26. This action also results in an area between the helix loops which is placed under a high seating pressure, i.e. the lead of both the terminal 12 and connector 10 being seated together under a high pressure which additionally contributes to high electrical conductance therebetween. Because these lead surfaces are seated solidly together, additional force is needed to remove the connector from terminal post 12. This reduces the opportunity for connector 10 to come loose due to vibrational and other mechanical forces. Additionally, this seating action means that no air or liquid (e.g. water) can reach the interior contact surfaces to cause oxidation and loss of a good electrical contact between connector 10 and post 12. The compressed area between the spirals of helix 26 provides a better electrical contact area than can be achieved by conventional external clamping bolts because the external clamping bolt has to exert its force through a large mass of soft lead, i.e. connector 10, which allows relaxation from the stress of the clamping force to a large degree.

This configuration has an additional advantage in that the height of connector 10 need only be a fraction of the height of post 12 above battery 14. This means that if the connector is removed from the battery, e.g. for charging of the battery, that connector 10 can be re-established on post 12 by screwing it down farther onto terminal 12. This feature also ensures that, if for some reason less than an optimal connection between connector 10 and post 12 has been established, a slight additional turn of connector 10 will re-establish maximum seating and electrical contact. In fact, the reusable battery connector of the present invention is so tightly affixed to the battery terminal post that the battery can be carried by grasping of the battery connectors.

While the description of threading helix 26 has been with reference to the preference of its being molded into the interior surface of connector 10 for providing a unitary structure, it will be appreciated that helix 26 can take the form of an electrically-conductive helical spring, such as spring 30 depicted at FIG. 4. Spring or helix 30 can be of the same configuration as helix 26, though it is a separate item from connector 10. In use, helix 30 can be screwed down around terminal post 12 in a first step. The second installation step requires connector 10 to then be screwed down around helix 30. Since connector 10 is of lead material, as is terminal post 12, helix 30 acts as a die to thread both terminal post 12 and the interior surface of connector 10. Accordingly, whether helix 26 or 30 is molded into the interior surface of connector 10 or provided as a separate item, all of the same benefits and advantages described above are realized.

Another feature of the present invention applies when a worn or undersized battery terminal is encountered. This occurrence can be compensated for by wrapping the worn or undersized terminal with a thin lead sheet before installing the novel battery connector. Because the local pressures generated by the inventive connector as depicted at FIG. 9 wherein lead sheet 44 is wrapped around terminal 12 on seating surfaces, the thin lead sheet would be seated against both the terminal surface and the connector surface resulting in an electrical contact and level of mechanical strength virtually equal to installation of the inventive battery connector with a new battery terminal.

Figure 7:
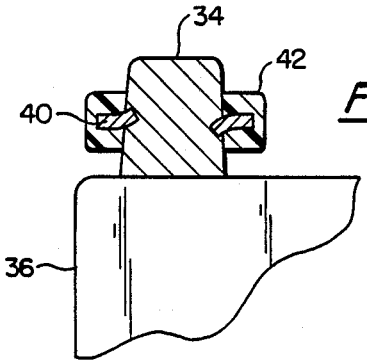
FIG. 7 is a cross-sectional elevational view taken along line 7—7 of FIG. 6.
Figure 8:
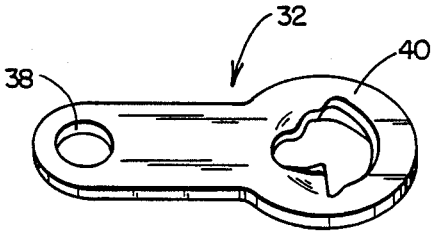
FIG. 8 is a perspective view of the battery connector depicted in FIG. 5.

While the description of threading helix 26 and 30 have been used to illustrate the inventive battery connector, it should be appreciated that the helix need not be continuous but could be of a discontinuous configuration, e.g. in the nature of teeth or discontinuous threads. An embodiment of the inventive connector utilizing such discontinuous helix or thread feature is depicted a FIGS. 5–8. Referring to these figures, electrical connector 32 will be seen connected to terminal post 34 of battery 36. One end of connector 32 has hole 38 penetrating therethrough for attaching an electrical cable thereto. Electrical connector 32 actually is composed of an electrical core and an outer plastic casing. Electrical connector core 40, depicted at FIG. 8, actually bears hole 38 at one end. About the other end is a hole which contains two teeth-like protrusions. It will be appreciated that two or more teeth-like protrusions can be used as is necessary, desirable, or convenient. The configuration may also be thought of as an offset hole through electrical core piece 40, which conveniently is copper or other electrically-conductive material. Connector core 40 will be observed to be capable of being threaded about, as a die, terminal post 34 (see FIG. 7). Its threading action into post 34 results in a firm mechanical connection with post 34 as well as a good electrical connection. Connector 32 can be further tightened by rotation. For convenience and minimization of exposed surfaces to electrical connector core 40, it preferably is encased in non-conductive plastic 42. It will be appreciated that a variety of plastics, polymers, ceramics, or like materials may be utilized in encasing conductive core 40. Such encasing material preferably is non-electrically conductive and desirably is an electrical insulator. The elongated shape of connector 32 provides lever action for screwing it down on terminal post 34.

It will be appreciated that the foregoing description merely is illustrative of the precepts upon which the present invention is based. Many modifications may be made to the battery connector of the present invention and still remain within the teachings herein as those skilled in the art will appreciate. Accordingly, all matter contained in the description hereof or shown in the accompanying drawings shall be interpreted as illustrative and not in a limiting sense.

We claim:

1. A method for attaching a battery connector to a metal terminal post of a battery which comprises providing a battery connector having a hole penetrating therethrough and adapted to fit around said terminal post, the interior surface of said hole bearing a threading helix having a diameter less than that of the terminal post; and screwing said connector onto said terminal post for threading said terminal post, the displaced metal of said terminal post being seated against the interior of said connector hole for improving the electrical conductance therebetween.

2. The method of claim 1 wherein a sheet of lead is wrapped about said terminal post prior to screwing said connector thereonto.

3. The method of claim 1 wherein said hole is tapered.

4. The method of claim 1 wherein said threading helix is continuous substantially the entire extent of said hole.

5. The method of claim 1 wherein said threading helix and said connector are separable.

6. The method of claim 1 wherein said threading helix is discontinuous and comprises at least two segments thereof.

7. The method of claim 1 wherein said helix comprises electrically-conductive material.

8. The method of claim 7 wherein said helix comprises copper.

9. The method of claim 1 which is encased in a non-conductive material except for said hole and threading helix.

10. The method of claim 9 wherein said non-conducting material comprises plastic.

* * * * *